US007503408B2

(12) United States Patent
Walker et al.

(10) Patent No.: US 7,503,408 B2
(45) Date of Patent: Mar. 17, 2009

(54) STEERING ASSEMBLY AND STEERING COMPONENT

(75) Inventors: Colin Walker, Conchez-de-Bearn (FR); Michael L. Larronde, Houston, TX (US)

(73) Assignee: Smart Stabilizer Systems Limited, Tewkesbury (GB)

( * ) Notice: Subject to any disclaimer, the term of this patent is extended or adjusted under 35 U.S.C. 154(b) by 46 days.

(21) Appl. No.: 11/627,555

(22) Filed: Jan. 26, 2007

(65) Prior Publication Data

US 2007/0187150 A1 Aug. 16, 2007

(30) Foreign Application Priority Data

Jan. 27, 2006 (GB) ..... 0601674.5

(51) Int. Cl.
*E21B 7/06* (2006.01)

(52) U.S. Cl. ..... 175/76; 175/73

(58) Field of Classification Search ..... 175/73–76
See application file for complete search history.

(56) References Cited

U.S. PATENT DOCUMENTS 4,319,649 A * 3/1982 Jeter ..... 175/73
2002/0185315 A1 12/2002 McLoughlin et al.

FOREIGN PATENT DOCUMENTS

GB 2425791 A 11/2006
WO 02059447 A1 8/2002

OTHER PUBLICATIONS

UK Intellectual Property Office, Search Report, Apr. 18, 2007, 1 page, UK.

* cited by examiner

*Primary Examiner*—Giovanna C Wright
(74) *Attorney, Agent, or Firm*—Mark A. Oathout

(57) ABSTRACT

This invention relates to a steering assembly and to a steering component, suitable for use in drilling operations for oil and gas. The steering assembly comprises a downhole motor which can rotate the drill bit, and a steering component. The steering component has a shaft and a set of elements for engaging the borehole in use. The shaft has a longitudinal axis. The set of elements has a centerline and is movable relative to the shaft between a first position in which the centerline is offset from the longitudinal axis of the shaft by a first distance, and a second position in which the centerline is offset from the longitudinal axis of the shaft by a second distance. In use in drilling operations, movement of the set of elements from the first position to the second position alters the degree of curvature of the drilled hole.

9 Claims, 3 Drawing Sheets

STEERING ASSEMBLY AND STEERING COMPONENT

FIELD OF THE INVENTION

This invention relates to a steering assembly and to a steering component. The steering assembly comprises in particular a downhole motor and a steering component.

The steering assembly is likely to have its greatest utility in steering a drill bit during drilling for oil and gas, and the following description therefore refers primarily to such applications. The use of the steering assembly in other applications is not thereby excluded.

BACKGROUND TO THE INVENTION

When drilling for oil and gas it is desirable to be able to steer the drill bit, i.e. to move the drill bit in a chosen direction, so that the drill bit does not have to follow a path determined only by gravity and/or the drilling conditions.

One method of steering a drill bit is to use a downhole motor with a "bent housing", i.e. a non-linear shaft. A downhole motor is connected to the drill bit and drives the drill bit to rotate with the remainder of the drill string not rotating, one such downhole motor being a mud motor which uses the flow of drilling mud to drive the drill bit. The bent housing allows the drill bit to follow a non-linear path in the direction of the bend in the shaft.

Often, this method and apparatus will be utilised when the desired direction and degree of curvature of the borehole is known. However, to cater for unexpected drilling conditions an operator will usually design the shaft with a greater bend than necessary, so that the desired degree of curvature can be achieved even if the drilling conditions result in the drill bit deviating from a linear path less than was expected. If, however, the drill bit does deviate as much as expected, this will result in the curvature of the borehole exceeding that desired, so that a linear (or more linear) length of borehole needs to be drilled to compensate. The linear (or more linear) length of borehole is drilled by rotating the whole of the drillstring, which continuously changes the direction of the bend in the shaft and cancels out the tendency to curve in one direction.

Unfortunately, drilling a more linear length of borehole in this way has a number of disadvantages, the most significant being the poor quality borehole which results due to the constantly changing drilling direction. Thus, whilst it is desired that the drilled borehole matches the diameter of the drill bit as closely as possible throughout its length (which facilitates the passage of stabilisers and other componentry along the borehole, and enables more reliable measurements to be obtained from sensors engaging the borehole) this is not always achievable with this method and apparatus.

Other steering apparatus and methods are known, for example the steering component described in our published European patent application EP-A-1025245. That steering component allows the drill bit to be moved in any chosen direction, i.e. the direction (and degree) of curvature of the borehole can be determined during the drilling operation, and as a result of the measured drilling conditions at a particular borehole depth. Despite the advantages of this steering component, some operators require a less complex steering system for the many applications in which the required borehole curvature can be predetermined.

SUMMARY OF THE INVENTION

The inventors have sought to provide a steering assembly suited to those applications in which the degree of borehole curvature can be predetermined, and which avoids or reduces the disadvantages of the bent-housing arrangements described above.

According to the invention, there is provided a steering assembly comprising:

a downhole motor and a steering component, the steering component having a shaft and a set of elements for engaging the borehole in use, the shaft having a longitudinal axis, the set of elements having a centreline and being movable relative to the shaft between a first position in which the centreline is offset from the longitudinal axis of the shaft by a first distance, and a second position in which the centreline is offset from the longitudinal axis of the shaft by a second distance.

Preferably, the second distance is zero, so that in its second position the centreline of the borehole-engaging elements is coaxial with the longitudinal axis of the shaft.

Accordingly, the degree of curvature for the borehole can be predetermined by setting the amount by which the centreline of the set of elements is offset from the longitudinal axis of the shaft. Thus, in use with the set of elements engaging the borehole wall, when the centreline of the set of elements is offset from the longitudinal axis of the shaft the shaft will be offset from the longitudinal axis of the borehole. Driving the drill bit to rotate when the longitudinal axis of the shaft is offset from the longitudinal axis of the borehole will cause the drill bit to deviate from a linear path and curve the borehole, and the greater the offset the greater the degree of curvature. However, when the centreline of the set of elements is coaxial with the shaft the drill bit will tend to follow a linear path.

Preferably, there is a stabiliser located between the drill bit and the steering assembly. The presence of a stabiliser between the drill bit and the steering assembly can enhance the quality of the drilled hole when the borehole follows a nonlinear path, as the stabiliser acts as a fulcrum for the drill bit, the drill bit deviating in the opposite direction to the offset of the axis of the shaft. The stabiliser also increases the maximum hole curvature which can be achieved by the offset elements.

Desirably, the set of elements is mounted on an annular sleeve, the annular sleeve having an inner surface, the inner surface being eccentric to the centreline of the borehole-engaging elements. Accordingly, rotation of the sleeve relative to the shaft alters the offset of the centreline relative to the longitudinal axis of the shaft.

Preferably, the sleeve is mounted for rotation on a part of the shaft, the part of the shaft having an outer surface which is eccentric to the longitudinal axis of the shaft. In such an arrangement, it is arranged that the sleeve and shaft part can adopt a first relative position in which the eccentricities are aligned and the centreline is offset by the first distance, and a second relative position in which the eccentricities are opposed and the centreline is offset by the second distance, the second distance being smaller than the first distance. Preferably, in the second relative position the eccentricities cancel each other out so that the centreline is not offset.

Desirably, the sleeve is resiliently biased towards the first relative position in which the eccentricities are aligned, so that the downhole assembly can be set at the surface to provide a predetermined degree of curvature for the borehole. When it is desired to drill in a (more) linear direction the sleeve can be moved to the second relative position. Preferably, the sleeve is moved to its second relative position by way of a frictional engagement with the borehole. Thus, the drillstring can be rotated whereupon the set of elements will cause drag upon the sleeve, it being arranged that the drag can overcome the resilient bias and move the sleeve to its second position relative to the shaft.

When it is desired to resume drilling in a non-linear direction the rotation of the drillstring can be stopped (with the eccentricity of the shaft part facing in a chosen direction), whereupon the drag upon the set of elements will cease and the resilient bias will cause the sleeve to rotate relative to the shaft to its first relative position.

There is also provided a steering component having a shaft and a set of elements for engaging the borehole in use, the shaft having a longitudinal axis, the set of elements having a centreline and being mounted on an annular sleeve, the annular sleeve having an inner surface, the inner surface being eccentric to the centreline, the annular sleeve being mounted for rotation on a part of the shaft, the part of the shaft having an outer surface which is eccentric to the longitudinal axis of the shaft, the set of elements being movable relative to the shaft between a first position in which the centreline is offset from the longitudinal axis of the shaft by a first distance, and a second position in which the centreline is offset from the longitudinal axis of the shaft by a second distance.

The steering component can be provided with an integral downhole motor to provide a steering assembly as described above, or it can be provided separately for connection into a drillstring together with the other desired componentry.

BRIEF DESCRIPTION OF THE DRAWINGS

The invention will be described, by way of example, with reference to the accompanying schematic drawings, in which.

DETAILED DESCRIPTION

Figure 1:
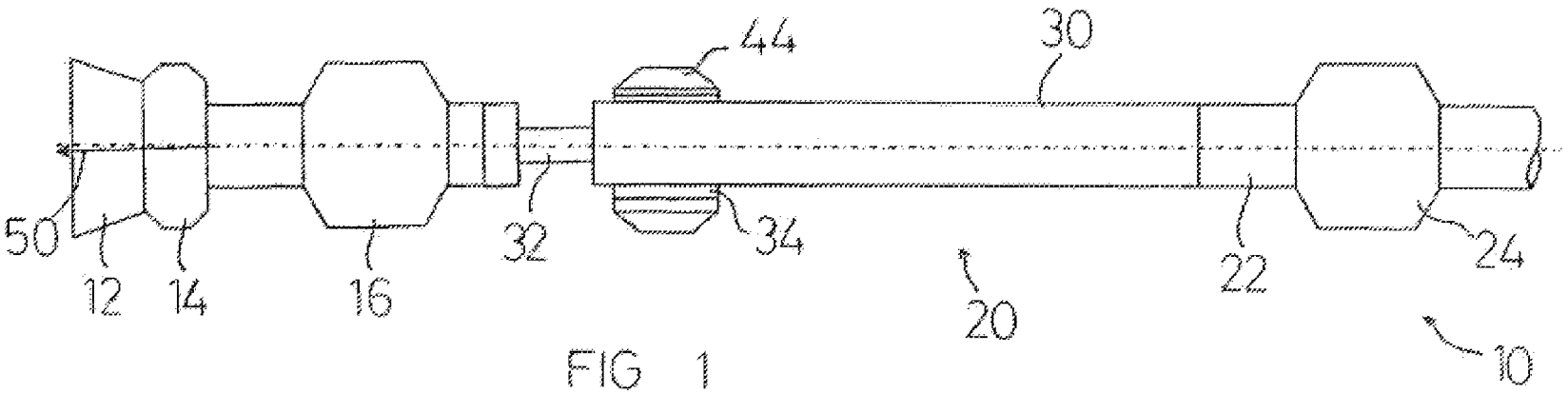
FIG. 1 shows a side view of a downhole assembly including a steering assembly according to the present invention, with the drillstring not rotating.
Figure 2:
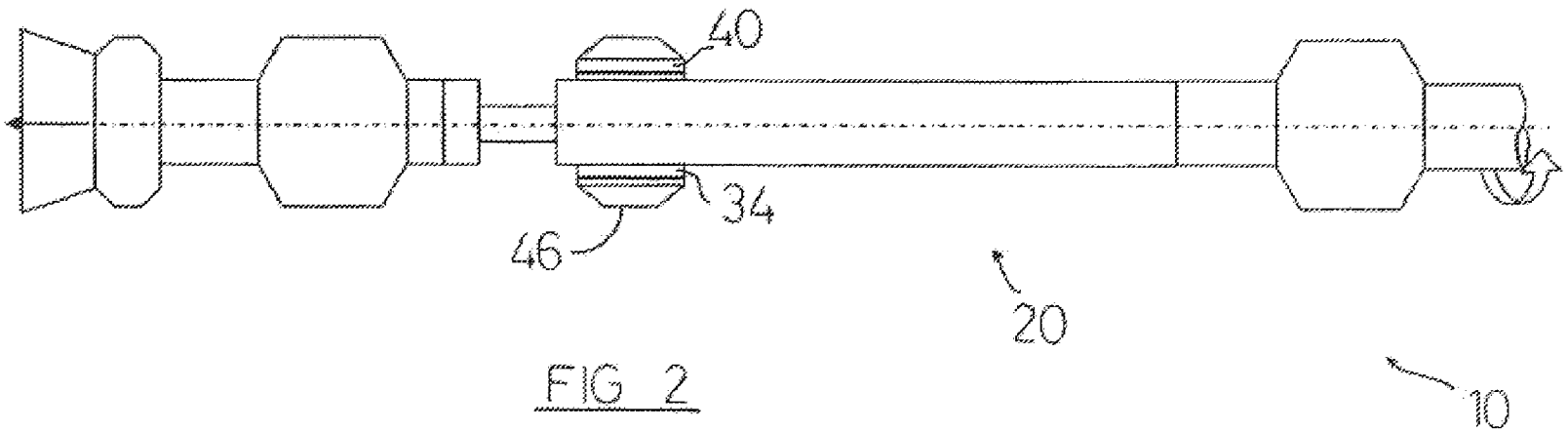
FIG. 2 shows a view as FIG. 1, but with the drillstring rotating.

The downhole assembly 10 shown in FIGS. 1 and 2 comprises a drill bit 12, a near-bit stabiliser 14, a pivot stabiliser 16, and the steering assembly 20. The steering assembly is connected to the bottom end of a drill string 22, the top end of which is connected to a drilling rig or the like at the surface (not seen). The drillstring 22 carries a number of string stabilisers 24, of which only one is seen.

It will be understood that in common with prior art downhole assemblies the drillstring 22, the steering assembly 20, and the stabilisers 16 and 14, are hollow so as to provide a passageway for the transmission of drilling fluid or mud to the drill bit 12. In addition, these components do not fill the drilled borehole, but instead allow the passage of drilling fluid and drill cuttings back to the surface around the outside of these components (or though channels in the outer surfaces of these components).

It will also be understood that the near-bit stabiliser 14 serves to centralise the drill bit 12 within the borehole, and can also serve to ream the borehole to ensure that it is closer to the designed diameter. The near-bit stabiliser is optional and is not required for all drill bits, and in particular is not a part of the present invention.

Figure 3:
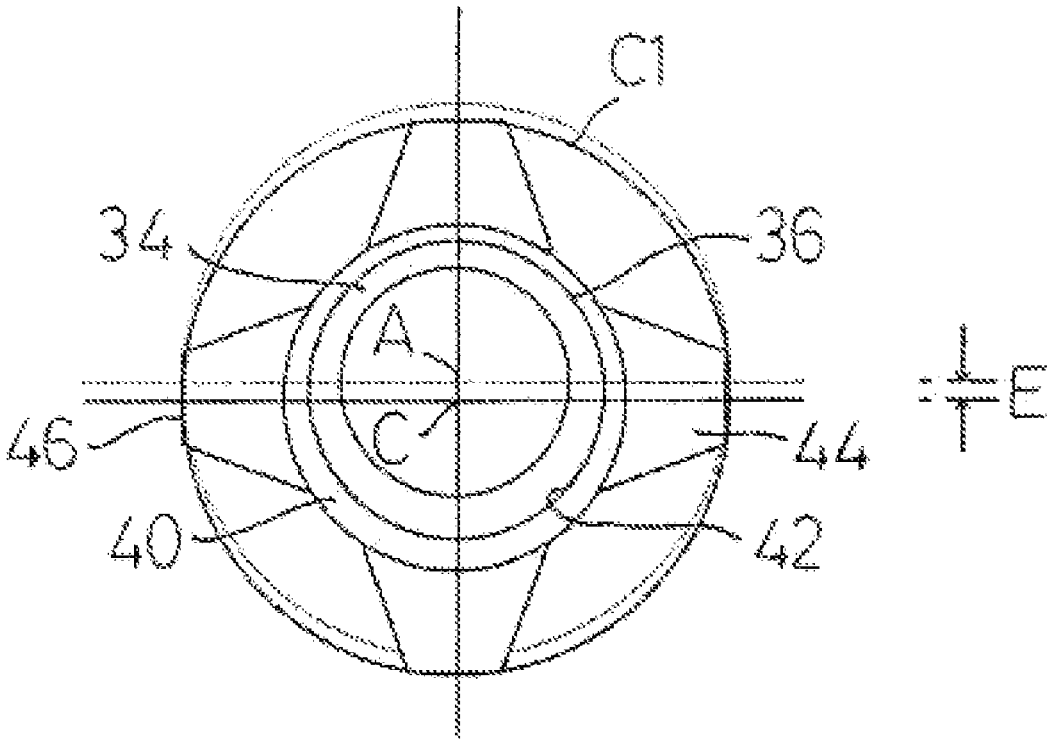
FIG. 3 represents a cross-section adjacent to the steering assembly of FIG. 1.
Figure 4:
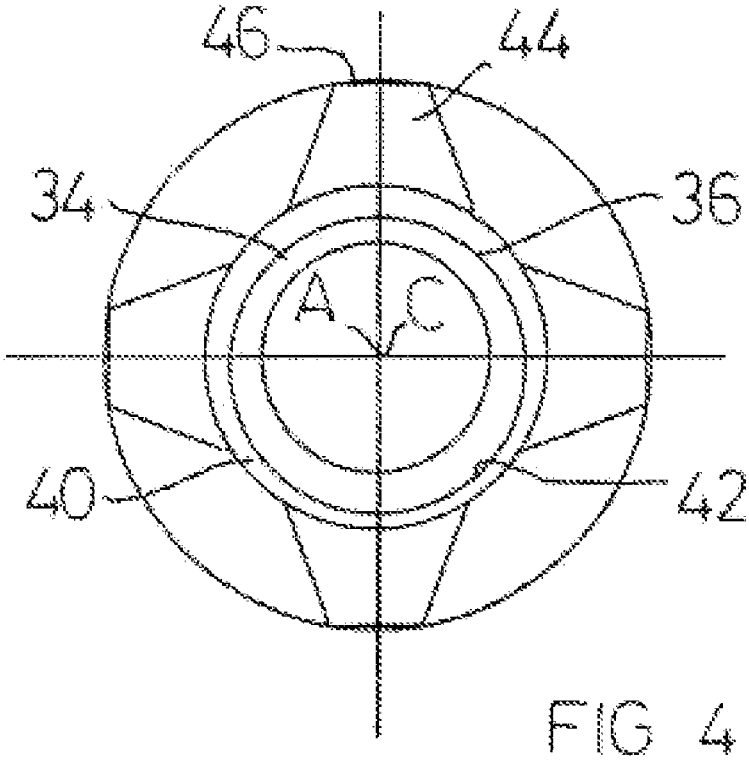
FIG. 4 represents a cross-section adjacent to the steering assembly of FIG. 2.

The steering assembly 20 according to the present invention comprises a shaft 30 which is substantially linear, and has a longitudinal axis A (FIGS. 3 and 4). Located within the shaft 30 is a downhole motor (not shown), the motor rotating the drive shaft 32 which in turn rotates the stabilisers 14, 16 and the drill bit 12. The downhole motor is preferably a mud motor but any motor which can rotate the drive shaft 32 whilst the drillstring 22 does not rotate can be used.

The steering assembly also comprises a steering component according to the present invention. Adjacent to one end the shaft 30 is enlarged into a shaft part 34. The outer surface 36 of the shaft part 34 is circular, but eccentric to the longitudinal axis A (as better seen in FIGS. 3 and 4). Mounted upon the shaft part 34 is a sleeve 40. The inner surface 42 of the sleeve 40 is also circular, of a size to allow the sleeve 40 to slidably rotate upon the outer surface 36 of the shaft part 34.

The sleeve 40 carries a set of elements 44. In this embodiment there are four elements 44 but in other embodiments there are three, five or more elements. The elements can be linear as shown in the cross-sectional views of FIGS. 3 and 4, with linear channels therebetween for the passage of drilling fluid and drill cuttings to the surface, or the elements and channels can be helical, as desired. The elements 44 are sized to engage the borehole in use, i.e. the distance from the end 46 of one element 44 to the end 46 of the opposite element 44 is substantially identical to the diameter of the drill bit 12. In the representations of FIGS. 3 and 4 the ends 46 of the elements 44 are shown as square, but in practice they would preferably be rounded to match the radius of the borehole.

In FIG. 3 a circle C1 has been drawn around the ends 46 of the elements 44, the circle C1 corresponding to the surface of the borehole in use. The circle C1 is centred on line C (which is perpendicular to the plane of the paper in this cross-sectional view), so that the ends 46 of the elements 44 are all equidistant from line C, and the line C therefore represents the centreline of the borehole-engaging elements 44.

Importantly, the inner surface 42 of the sleeve 40 is eccentric to the centreline C, and is therefore also eccentric to the ends 46 of the elements 44.

In this embodiment the eccentricity of the inner surface 42 of the sleeve 40 matches the eccentricity of the outer surface 36 of the shaft part 34 to the longitudinal axis A. Accordingly, when the sleeve 40 is rotated to its first position as shown in FIGS. 1 and 3, the eccentricities are aligned and the centreline C of the borehole-engaging elements 44 is offset by an eccentric distance E from the longitudinal axis A.

Alternatively, when the sleeve 40 is rotated to its second position as shown in FIGS. 2 and 4, the eccentricities are opposed and cancel out, so that the centreline C is coincident with the longitudinal axis A.

It is not necessary that the eccentricities match and are able to cancel each other out as in the embodiment shown, and instead there could be some (reduced) eccentricity in the second relative position. However, matching eccentricities are preferred as this allows the drilling of a substantially linear borehole.

A comparison of FIGS. 3 and 4 will show that the sleeve 40 must be rotated relative to the shaft part 34 by 180° between its first and second positions. Nevertheless, in this embodiment the outer surface 36 of the shaft part 34, and the inner surface 42 of the sleeve 40, are both fully circular, and one or other of the sleeve 40 and the shaft part 34 will carry a stop or stops to limit the rotation of the sleeve to the 180° required.

Figure 5:
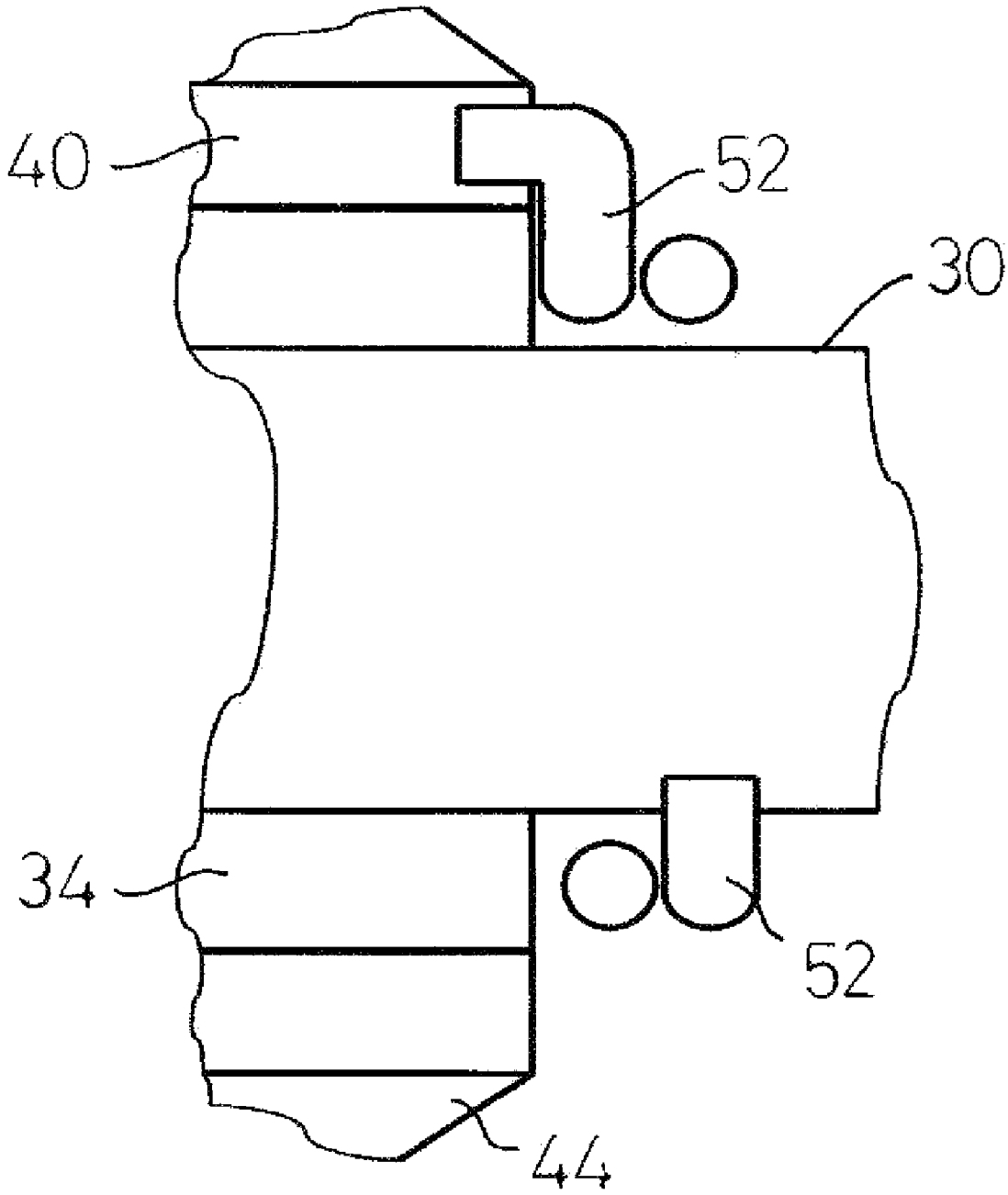
FIG. 5 represents a part of an alternative embodiment of downhole assembly.

FIG. 5 shows a resilient biasing member 52 which is provided to urge the sleeve 40 to rotate relative to the shaft part 34 to its first position, i.e. to that position shown in FIGS. 1 and 3. The resilient biasing member 52 in this embodiment is a torsion spring, for example.

When the operator is setting up for a drilling operation in which the direction and degree of curvature required for the borehole is known, the downhole assembly 10 will be constructed to achieve an expected degree of curvature slightly greater than the curvature required for the borehole, in order to cater for adverse drilling conditions in known fashion. The degree of curvature which is expected for a particular downhole assembly 10 can be determined empirically or by experiment, it being recognised that the degree of curvature will depend upon the dimension E defining the eccentricity of the steering component, the separation between the elements 44 and the pivot stabiliser 16, the separation between the pivot stabiliser 16 and the drill bit 12, and the material through which the borehole is being drilled.

When drilling is underway, the actual degree of curvature of the borehole being achieved can be determined by sensors carried by the downhole assembly as in the prior art arrangements, most preferably by suitable sensors mounted between and/or within the stabilisers 14 and 16, i.e. as close to the drill bit 12 as practicable.

Under the influence of the resilient biasing member the sleeve 40 will normally adopt its first position and the longitudinal axis A of the shaft 30 will be held away from the centreline C of the borehole-engaging elements (and consequently held away from the centreline of the borehole) as shown in FIGS. 1 and 3 (the longitudinal axis A is above the centreline C in the orientation of FIGS. 1 and 3). The stabiliser 16 is thereby caused to pivot slightly and cause a lateral (downwards in the orientation of FIG. 1) force upon the drill bit 12. Accordingly, in the orientation of FIG. 1 the drill bit 12 is urged to follow a downward path as represented by the arrow 50, so that the borehole curves downwardly.

The drilling conditions may be such as to cause the borehole to curve at the rate required by the operator, in which case drilling can continue without alteration. However, if the curvature of the borehole is exceeding that required it is necessary to drill a (more) linear section of borehole to compensate.

With the present steering apparatus a (more) linear section of borehole can be drilled by rotating the drillstring 22 from the surface, which also rotates the steering assembly 20. It is arranged that upon rotation of the steering assembly 20, the elements 44 (the ends 46 of which engage the borehole wall) drag upon the borehole wall, and in particular drag sufficiently to overcome the resilient biasing member, rotating the sleeve 40 relative to the shaft part 34 into its second position as shown in FIGS. 2 and 4. In this position the longitudinal axis A of the shaft is aligned with the centreline C, and there is no lateral force upon the drill bit 12 so that the borehole is drilled linearly (or more accurately is drilled more linearly, even for embodiments such as this in which the eccentricities match, as gravity and other effects may cause the borehole to deviate from a linear path).

As long as the drillstring 22 is rotating the drag of the elements 44 will continue and the sleeve 40 will be held in its second position. When it is desired to resume curvature of the borehole the rotation of the drill string is stopped and the resilient biasing member urges the sleeve 40 back to its first position.

It will be understood that the rotation of the drillstring 22 must be measured at the surface, or else directional sensors must be provided on the downhole assembly 10, so that when the drillstring 22 stops rotating the eccentricity of the shaft part 34 is facing in the correct direction so that the borehole curves in the desired direction.

The invention claimed is:

1. A steering assembly comprising:

a downhole motor and a steering component, the steering component having a shaft and a set of elements for engaging a borehole in use, the shaft having a longitudinal axis, the set of elements having a centreline and being movable relative to the shaft between a first position in which the centreline is offset from the longitudinal axis of the shaft by a first distance, and a second position in which the centreline is offset from the longitudinal axis of the shaft by a second distance, in which the set of elements is mounted on an annular sleeve, the annular sleeve having an inner surface, the inner surface being eccentric to the centreline, in which the annular sleeve is mounted for rotation on a part of the shaft, the part of the shaft having an outer surface which is eccentric to the longitudinal axis of the shaft, in which the sleeve is resiliently biased towards the first position relative to the shaft, and in which the sleeve can be moved to its second position relative to the shaft by way of a frictional engagement between the set of elements and the borehole.

2. A steering assembly according to claim 1 in which the second distance is zero.

3. A steering assembly according to claim 1 in which there is a stabiliser located between the drill bit and the steering assembly.

4. A steering assembly according to claim 1 in which the inner surface is circular.

5. A steering assembly according to claim 1 in which the outer surface is circular.

6. A steering component having a shaft and a set of elements for engaging borehole in use, the shaft having a longitudinal axis, the set of elements having a centreline and being mounted on an annular sleeve, the annular sleeve having an inner surface, the inner surface being eccentric to the centreline, the annular sleeve being mounted for rotation on a part of the shaft, the part of the shaft having an outer surface which is eccentric to the longitudinal axis of the shaft, the set of elements being movable relative to the shaft between a first position in which the centreline is offset from the longitudinal axis of the shaft by a first distance, and a second position in which the centreline is offset from the longitudinal axis of the shaft by a second distance in which the sleeve is resiliently biased towards the first position relative to the shaft. and in which the sleeve can be moved to its second position relative to the shaft by way of a frictional engagement between the set of elements and the borehole.

7. A steering component according to claim 6 in which the second distance is zero.

8. A steering component according to claim 6 in which the inner surface is circular.

9. A steering component according to claim 6 in which the outer surface is circular.

* * * * *